US008469148B2

(12) United States Patent
Perry

(10) Patent No.: US 8,469,148 B2
(45) Date of Patent: Jun. 25, 2013

(54) LADDER TRAY

(76) Inventor: Calvidge C. Perry, Owensboro, KY (US)

( * ) Notice: Subject to any disclaimer, the term of this patent is extended or adjusted under 35 U.S.C. 154(b) by 352 days.

(21) Appl. No.: 12/660,220

(22) Filed: Feb. 22, 2010

(65) Prior Publication Data

US 2011/0203873 A1 Aug. 25, 2011

(51) Int. Cl.
*E06C 7/14* (2006.01)

(52) U.S. Cl.
USPC ..... 182/129; 182/122; 248/238; 248/240.4

(58) Field of Classification Search
USPC ..... 182/129, 122, 121; 248/237, 240.4, 248/238; 108/77, 78, 134, 159, 157.13, 160, 108/42, 46, 47
See application file for complete search history.

(56) References Cited

U.S. PATENT DOCUMENTS

| | | | | | |
|---|---|---|---|---|---|
| 162,595 | A | * | 4/1875 | Woodruff | 108/135 |
| 330,721 | A | * | 11/1885 | McBlair | 108/179 |
| 1,515,420 | A | * | 11/1924 | Traylor | 182/103 |
| 1,890,526 | A | * | 12/1932 | McEwing | 108/134 |
| 1,898,865 | A | * | 2/1933 | Balch | 108/134 |
| 1,903,954 | A | * | 4/1933 | Blumenthal | 297/158.2 |
| 1,943,626 | A | * | 1/1934 | Richard | 182/121 |
| 2,720,436 | A | * | 10/1955 | Covey | 297/163 |
| 2,907,616 | A | * | 10/1959 | Sullivan | 108/66 |
| 2,911,108 | A | * | 11/1959 | Nield | 108/152 |
| 2,922,683 | A | * | 1/1960 | Schmertz | 108/93 |
| 3,229,943 | A | * | 1/1966 | Olson | 248/210 |
| 3,285,206 | A | * | 11/1966 | Hoffman | 108/134 |
| 3,332,373 | A | * | 7/1967 | Ruiz | 108/77 |
| 3,829,051 | A | | 8/1974 | Emmons | |
| 4,216,951 | A | * | 8/1980 | Griffin | 5/655 |
| 4,476,984 | A | | 10/1984 | Garrett | |
| 4,515,242 | A | * | 5/1985 | LaChance | 182/106 |
| 4,834,449 | A | * | 5/1989 | Engelman | 297/145 |
| 4,991,808 | A | * | 2/1991 | LaChance | 248/211 |
| 5,052,581 | A | | 10/1991 | Christ et al. | |
| 5,079,795 | A | | 1/1992 | Schmid | |
| 5,099,952 | A | * | 3/1992 | Farrell | 182/122 |
| 5,342,008 | A | | 8/1994 | Kay | |
| 5,431,249 | A | | 7/1995 | Tredup | |
| 5,727,649 | A | | 3/1998 | Buckley | |
| 5,957,238 | A | | 9/1999 | Curvin | |
| 6,131,699 | A | | 10/2000 | Leak | |

(Continued)

FOREIGN PATENT DOCUMENTS

GB 2009063 12/1982

*Primary Examiner* — Alvin Chin Shue
*Assistant Examiner* — Daniel Cahn
(74) *Attorney, Agent, or Firm* — Carrithers Law Office PLLC

(57) ABSTRACT

A tray for supporting tools, paint cans, painting supplies and the like is pivotally held in a selected position by an elongated frame removably attached to a ladder rail. The ladder tray includes a folding shelf, a shelf support, a rail embracing frame, a hinge means connecting the shelf and support to the frame, and hooks for engaging the rungs of the ladder. A variety of apertures, depressions and/or raised areas exist on the tray in various sizes and shapes and are adapted for holding tools or for temporary placement of cans, bottles, jugs, tools and the like on shelf. When mounted, the ladder tray extends out from one side of the ladder and does not prevent a user from climbing up or down the ladder. It may be folded down alongside the rail of the ladder to a space saving transport or storage position or may be folded and removed from the ladder to store.

3 Claims, 10 Drawing Sheets

U.S. PATENT DOCUMENTS

| | | | | |
|---|---|---|---|---|
| 6,474,607 | B1 | 11/2002 | Wilson | |
| D484,251 | S | 12/2003 | Pruett et al. | |
| D500,145 | S | 12/2004 | Cromberg | |
| D576,292 | S | 9/2008 | Brown | |
| 7,520,479 | B1 | 4/2009 | Conner | |
| 2002/0100848 | A1 | 8/2002 | Ahl et al. | |
| 2003/0085074 | A1 | 5/2003 | Harmston | |
| 2003/0209387 | A1* | 11/2003 | Burr | 182/129 |
| 2011/0011676 | A1* | 1/2011 | DeLair | 182/129 |
| 2011/0204183 | A1* | 8/2011 | Chua et al. | 244/118.6 |

* cited by examiner

LADDER TRAY

BACKGROUND OF THE INVENTION

1. Technical Field

The present invention relates to the field of detachable trays or shelves for use on a ladder to support tools, buckets, and the like as needed.

2. Description of the Prior Art

Movable utility storage racks and brackets have been fabricated to provide support for holding paint and tools on a ladder extending in a horizontal plane independent of the inclination of the ladder to which it is attached. In this way containers containing paint or other liquids can be kept level and slipping and sliding of such containers and other materials supported by the attachment can be avoided. Many of these devices are not adjustable at all, are sometimes, heavy and difficult to attach and remove, or are bulky and cumbersome to use or store. Many of these conventional ladder trays are difficult to mount and awkward to use.

U.S. Pat. No. 3,829,051 by Emmons for DETACHABLE SUPPORT TRAY FOR LADDERS issued on Aug. 13, 1974 teaches a shelf with adjustable brackets shaped to loop over and around a ladder rail and to embrace a rung for stability. Emmons' tray is supported on a ladder by four adjustable brackets which must be moved into position whenever the tray is moved. These adjustments are cumbersome and time consuming. Also, Emmons does not provide tool holding apertures in the shelf.

Shelves and boxes are supported on a ladder in U.S. Pat. No. 4,476,984 by Garret for STORAGE RACK issued on Oct. 16, 1984. Garret's assembly is held between the rails of a ladder. This places the assembly in the way if a user needs to climb to or above the level of the tray for some reason. Garret also does not provide tool holders in his shelving.

U.S. Pat. No. 4,991,808 by LaChance for MOVABLE UTILITY BRACKET FOR LADDERS issued on Feb. 12, 1991 teaches a ladder rail and rung embracing bracket onto which shelves, hangers, buckets and the like may be hung. LaChance teaches a rail and rung embracing bracket but does not provide a tray surface or shelf. A safety handle or rail is provided on the utility bracket, but these are in the way and are unnecessary because the user has rungs and rails to be used as a safety grip.

A ladder tray is needed which is easy to install and remove, is light, folds up into a small area for storage while on or off the ladder, and has plenty of storage room and holes for securely holding tools, brushes and the like.

SUMMARY OF THE INVENTION

The present invention comprises a ladder tray for supporting tools, paint cans, painting supplies and the like which can be quickly installed onto or removed from a typical ladder or extension ladder. It includes a folding shelf, a shelf support, a rail embracing frame and hinges connecting the three. The frame hooks over two rungs as it slides down into a grasping attitude over a rail on the ladder. It is made from structural foam material, aluminum, fiberglass, plastic or combinations thereof, or any appropriately strong and light material. When mounted, the shelf extends out from one side of the ladder and does not prevent a user from climbing above or beside the ladder tray, if desired. The shelf may be folded down alongside the rail of the ladder to a space saving transport or storage position. Due to the it's light weight and foldability, the ladder may easily be moved, carried, or even stored with the ladder tray in place. Further, the shelf has several holes for holding tools when desired.

Presented herein is a ladder tray removably mountable to a ladder rail and rung assembly. The ladder tray includes an elongated frame secured to the ladder and a foldable shelf pivotally secured to the elongated frame, and having a shelf support pivotally secured to the elongated frame extending outwardly for supporting the shelf from beneath.

It is an object of this invention to provide a ladder tray which may be quickly and securely installed onto the rail of a typical ladder.

It is an object of this invention to provide a ladder tray which is light, folds down to a space saving configuration whereupon it maybe removed form the ladder or remain on the ladder and is easy to adjust, move or transport.

It is an object of this invention to provide a ladder tray which contains plenty of shelf space and integrated tool holders in the form of holes in the shelf.

It is an object of this invention to provide a ladder tray which contains a major rim around the outside of the shelf and minor rimmed areas and/or depressions in the upper surface of the shelf to help hold tools, containers and the like in position on the shelf during use.

It is an object of this invention to provide a ladder tray which is easy and inexpensive to manufacture.

It is another object of this invention to provide a tray for supporting paint cans, buckets, tools and the like is quickly and easily removably attachable to or removable from the side rail of a ladder.

It is another object of this invention to provide a tray including a latch assembly which can be manually manipulated by one hand to secure it to or change it from selected points of attachment on a ladder as may be desired for convenient access.

It is another object of this invention to provide a tray having a foldable shelf extending laterally outwardly from the ladder so as to not interfere with the normal use of the ladder.

It is another object of this invention to provide a tray which is foldable into a compact unit for storage or transportation.

It is another object of this invention to provide a ladder tray which includes an elongated frame extending at an angle of from between 10 to 20 degrees, and more preferably about 15 degrees, and most preferably about 15.6 degrees from a horizontal plane which represents the manufacturer's recommended angle between a ladder and the vertical support upon which the ladder rests.

It is another object of this invention to provide a tray which is adjustable for accommodation to ladder side rails of different thicknesses.

It is another object of the present invention to provide an elongated frame having a foldable shelf attached thereto supported by a pivoting support member in order that the ladder tray can be folded up in a flat package for transport or storage.

In another embodiment, a ladder tray consists of an apparatus for supporting tools, paint cans, painting supplies and the like is held in an extended position by an elongated frame removably attached to a ladder rail with at least a pair of hooks fitting over at least two rungs of the ladder enabling quick installation and removal from a straight ladder or extension ladder. The ladder tray includes a folding shelf which can be pivotally connected to a rotatable joint providing for a level shelf regardless of the angle of the ladder with respect to the ground, a shelf support, a rail embracing frame and hinge means connecting the shelf and support to the frame. The ladder tray frame is attached to the ladder by hooks engaging the rungs, whereby the elongated frame includes means for holding extending from its sides forming an elongated slot or groove cooperatively engaging a selected side rail of the ladder providing lateral support therefor. The ladder tray components are composed of plastic, structural foam material, aluminum, fiberglass, graphite material, wood, laminated or corrugated paper, or combinations thereof, or any other appropriately strong and light material. When mounted, the shelf extends out from one side of the ladder and does not prevent a user from climbing up or down the ladder. It may be folded down alongside the rail of the ladder to a space saving transport or storage position or may be folded and removed form the ladder to store. Due to the tray's light weight and foldability, the ladder may easily be moved, carried, or even stored with the tray in place. A variety of apertures in various sizes and shapes are adapted for holding tools and a plurality of depressions or raised areas forming grooves or ridges in the surface of the shelf provide safe movement resisting areas for temporary placement of cans, bottles, jugs, tools and the like on shelf areas.

Thus, a preferred embodiment of a ladder tray consists essentially of a foldable shelf for supporting tools, paint cans, painting supplies and the like is held in a selected position by an elongated frame removably attached to a ladder rail with at least a pair of hooks fitting over at least two rungs of the ladder enabling quick installation and removal from a straight ladder or extension ladder. The ladder tray includes a folding shelf, a shelf support, a rail embracing frame and hinge means connecting the shelf and support to the frame. The ladder tray frame is attached to the ladder by hooks engaging the rungs, whereby the elongated frame includes means for holding extending from its sides forming an elongated slot or groove cooperatively engaging a selected side rail of the ladder providing lateral support therefor. The ladder tray components are composed of plastic, structural foam material, aluminum, fiberglass, graphite material, wood, laminated or corrugated paper, or combinations thereof, or any other appropriately strong and light material. When mounted, the shelf extends out from one side of the ladder and does not prevent a user from climbing up or down the ladder. It may be folded down alongside the rail of the ladder to a space saving transport or storage position or may be folded and removed form the ladder to store. Due to the tray's light weight and foldability, the ladder may easily be moved, carried, or even stored with the tray in place. A variety of apertures in various sizes and shapes are adapted for holding tools and a plurality of depressions or raised areas forming grooves or ridges in the surface of the shelf provide safe movement resisting areas for temporary placement of cans, bottles, jugs, tools and the like on shelf areas.

In another preferred embodiment, the ladder tray comprises an apparatus for supporting tools, paint cans, painting supplies and the like is held in a selected position by an elongated frame removably attached to a ladder rail with at least a pair of hooks fitting over at least two rungs of the ladder enabling quick installation and removal from a straight ladder or extension ladder. The ladder tray includes a folding shelf, a shelf support, a rail embracing frame and hinge means connecting the shelf and support to the frame. The ladder tray frame is attached to the ladder by hooks engaging the rungs, whereby the elongated frame includes means for holding extending from its sides forming an elongated slot or groove cooperatively engaging a selected side rail of the ladder providing lateral support therefor. The ladder tray components are composed of plastic, structural foam material, aluminum, fiberglass, graphite material, wood, laminated or corrugated paper, or combinations thereof, or any other appropriately strong and light material. When mounted, the shelf extends out from one side of the ladder and does not prevent a user from climbing up or down the ladder. It may be folded down alongside the rail of the ladder to a space saving transport or storage position or may be folded and removed form the ladder to store. Due to the tray's light weight and foldability, the ladder may easily be moved, carried, or even stored with the tray in place. A variety of apertures in various sizes and shapes are adapted for holding tools and a plurality of depressions or raised areas forming grooves or ridges in the surface of the shelf provide safe movement resisting areas for temporary placement of cans, bottles, jugs, tools and the like on shelf areas. The ladder tray can include a folding shelf which can be pivotally connected to a rotatable joint providing for a level shelf regardless of the angle of the ladder with respect to the ground. Moreover, removable shims may be used as an adjustable spacing means disposed between the slot formed in the elongated frame and the ladder rail to provide a tight fit for ladders having a smaller rail size as for instance the difference between a fiberglass ladder rail and an aluminum or wood ladder rail member.

Other objects, features, and advantages of the invention will be apparent with the following detailed description taken in conjunction with the accompanying drawings showing a preferred embodiment of the invention.

BRIEF DESCRIPTION OF THE DRAWINGS

A better understanding of the present invention will be had upon reference to the following description in conjunction with the accompanying drawings in which like numerals refer to like parts throughout the views wherein.

DESCRIPTION OF THE PREFERRED EMBODIMENTS

In accordance with the present invention, there is provided a ladder tray for supporting tools, paint cans, painting supplies and the like which can be quickly installed onto or removed from a typical ladder or extension ladder.

The entire ladder tray may be made from structural foam material, sheet metal, aluminum, fiberglass, plastic or combinations thereof, or any appropriately strong and light material. The hinges may also be metal, plastic or any appropriately strong material.

Figure 1:
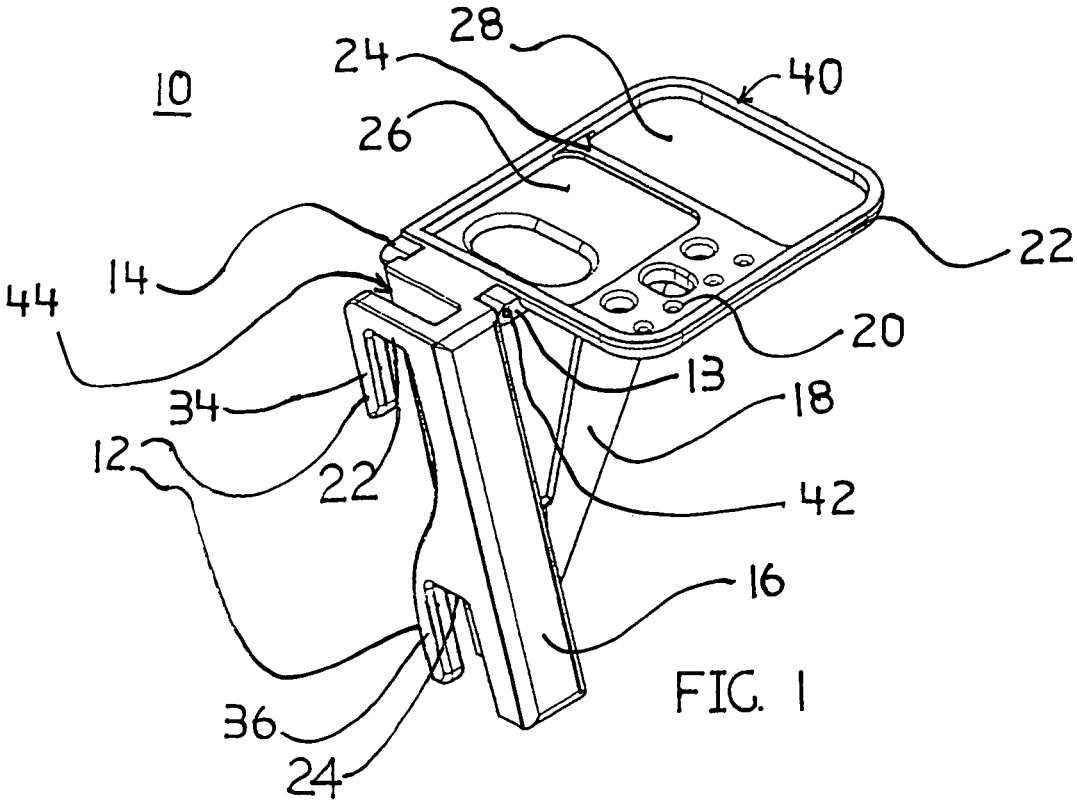
FIG. 1 is a perspective view of the ladder tray showing the longitudinal frame having a foldable shelf extending therefrom supported by a support member.
Figure 5:
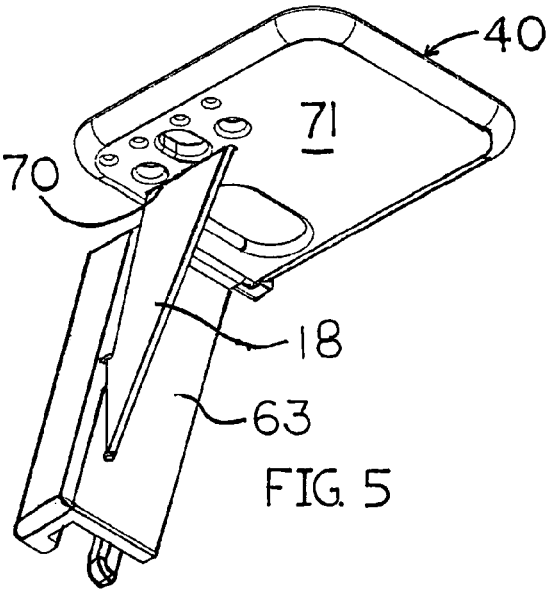
FIG. 5 is a bottom perspective view of the ladder tray.
Figure 6:
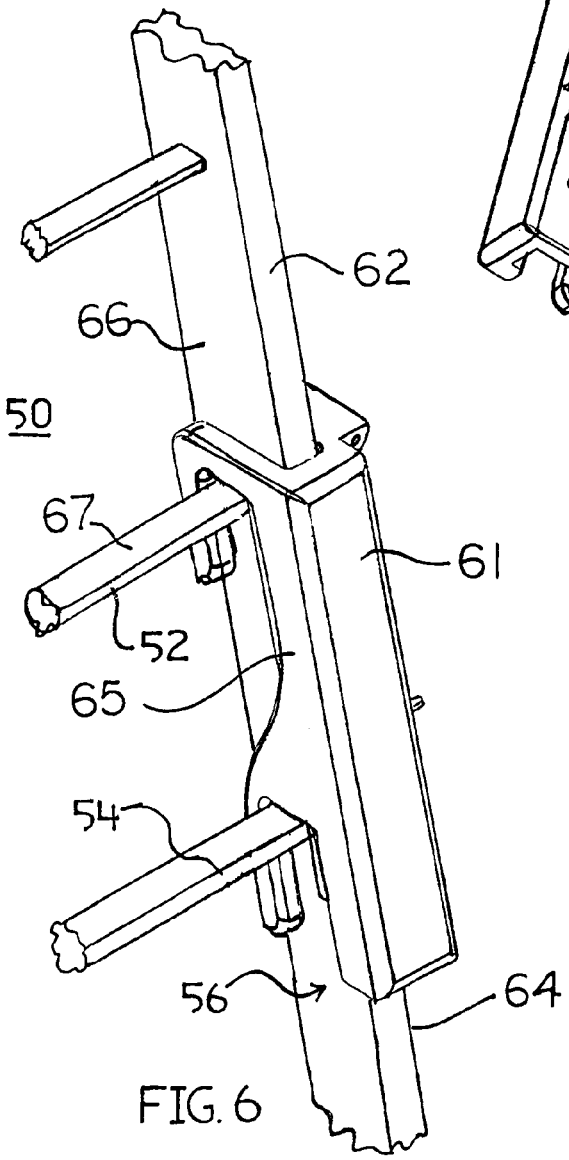
FIG. 6 is a perspective view of the ladder tray attached to a side rail of a ladder showing the hooks engaging the rungs.

FIGS. 1-18 show various embodiments of a ladder tray 10 including a folding shelf 40, a shelf support 18 and a rail 56 and rung 52, 54 embracing elongated frame 16. As shown in FIG. 1, rail embracing elongated frame 16 has an elongated cavity or channel 44 which can receive ladder rail 56 as shown in FIG. 6. The portion of the elongated frame 16 which receives the inside surface of the ladder rail is formed to define downward oriented"C-shaped" hooks 12 having a generally flat interior surface 22, 24 to support the elongated frame on a ladder rung and having a distal end define fingers 34, and 36 respectively, extending downward over the ladder rung preventing and/or limiting lateral movement of the elongated frame on the ladder rungs. The interior portion of the hooks 12 forming voids to receive consecutive ladder rungs 52 and 54, whereupon the elongated frame 16 securely embraces ladder 50.

Figure 2:
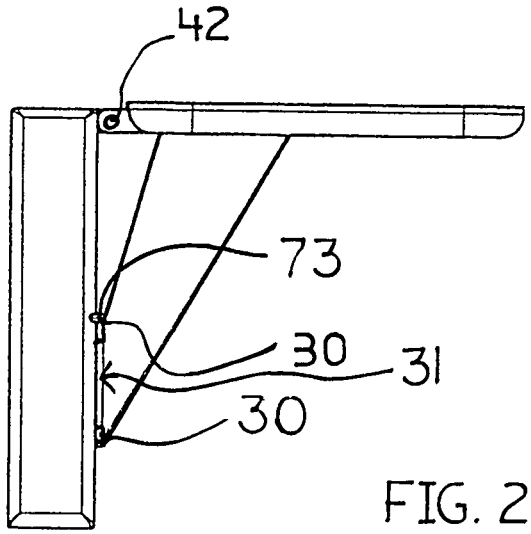
FIG. 2 is a front view of the ladder tray.
Figure 3:
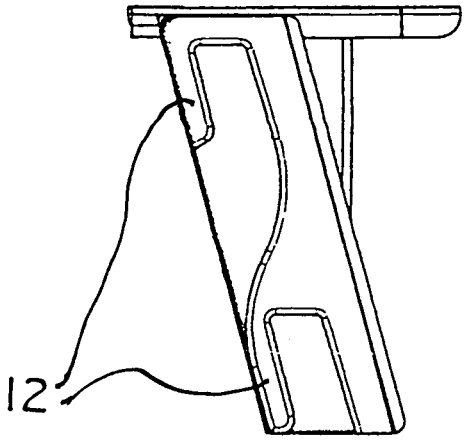
FIG. 3 is a left side view of the ladder tray.
Figure 4:
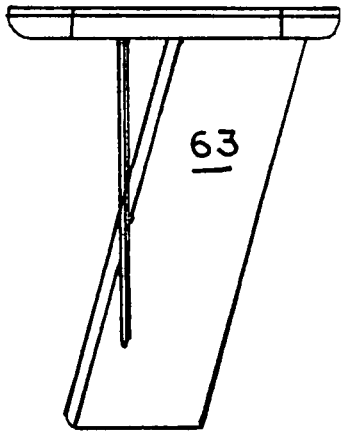
FIG. 4 is a right side view of the ladder tray.
Figure 7:
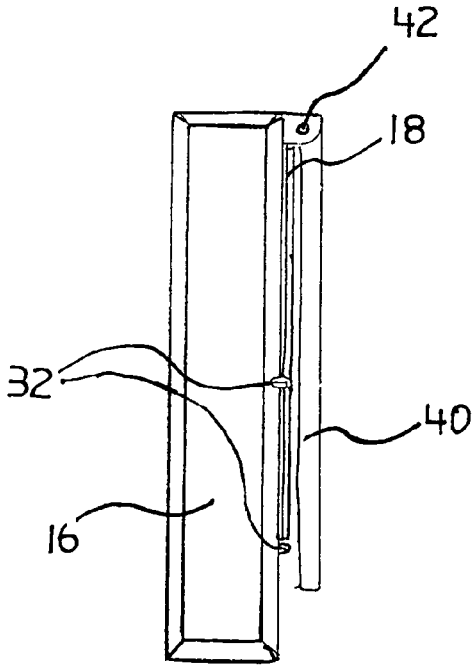
FIG. 7 is a front view of a ladder tray folded to its storage configuration.
Figure 8:
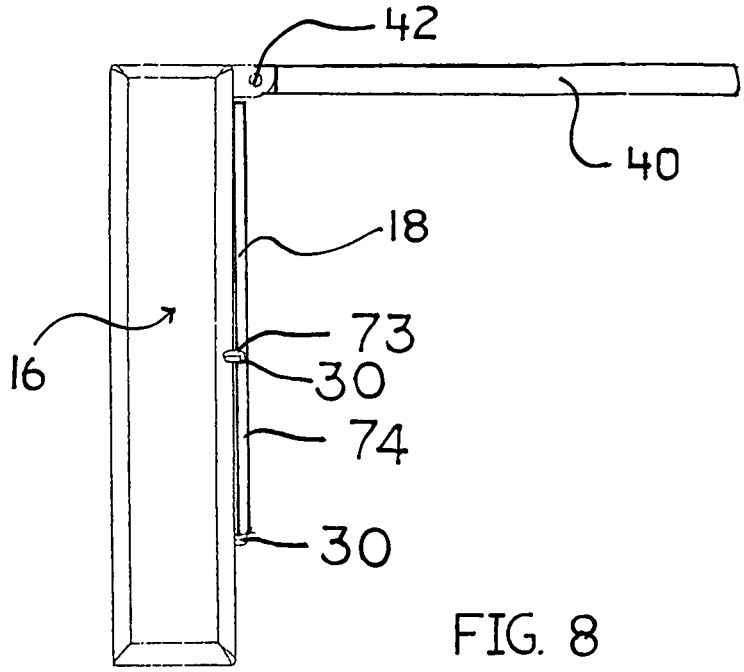
FIG. 8 is a front view of a ladder tray with it shelf extended but with its support member still folded.
Figure 9:
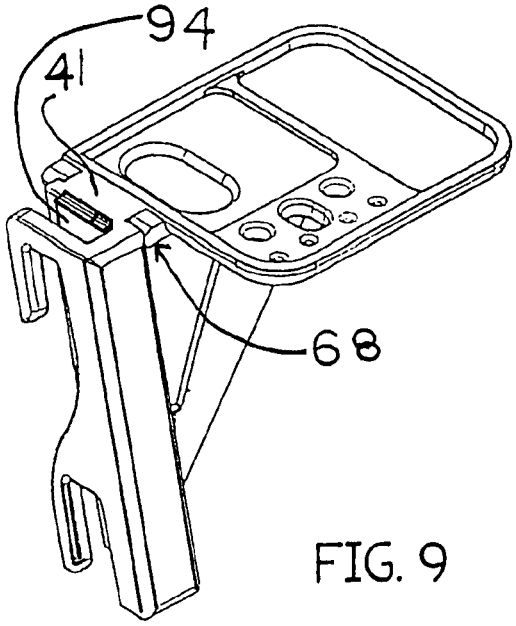
FIG. 9 is a perspective view of a ladder tray shown in FIG. 1, including a shim disposed in the channel of the elongated frame.
Figure 10:
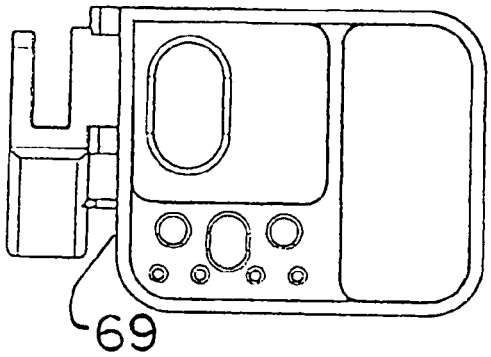
FIG. 10 is a top view of a ladder tray showing the peripheral rim extending around the shelf and apertures formed within the shelf.
Figure 11:
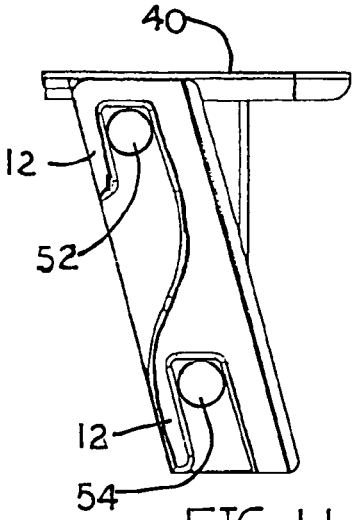
FIG. 11 is a left side view of a ladder tray mounted upon the rungs of a ladder.

In one preferred embodiment, a shelf 40 is foldably attached to elongated frame 16 by a pin 42 which protrudes through lugs 13 and 14 of shelf 40 and through a frame lug 41 extending from the top right edge of frame 16 as shown. As best shown in FIGS. 2 and 5, a pair of spaced apart and aligned frame lugs 30 extend on frame 16 through which pin 32 passes. Pin 32 also passes through the vertical edge of shelf support 18 mounting onto the lugs 30 forming a hinge 31 by which a longitudinal support member 18 can pivot to a flat storage position as shown in FIG. 7 or extend to a shelf supporting position as shown in FIGS. 1 and 2. FIG. 4 shows a right end view of ladder tray 10 in a shelf usable configuration whereas. FIG. 8 shows support 18 folded in against frame 16 and shelf 40 still folded outwardly.

As shown in FIGS. 1, 9, 10, and 18, foldable shelf 40 comprises a peripheral rim 22 and includes a plurality of tool holding apertures 20 and tool holding edges 24 forming divided areas with depressions or raised areas for resisting movement of paint cans and other objects held therein. Tools such as paint brushes, scrapers, drills, screw drivers, hammers and the like may be held within these apertures. Raised edge 22 forms a fence around the upper surface of the entire shelf area of shelf 40. Raised edge 24 divides minor shelf areas 26 and 28. These edges help to secure tools and the like from sliding around or off the edge of shelf 40.

In another preferred embodiment of the ladder tray 10 for ladders comprises or consists essentially of an elongated frame 16 including a channel 44 for receiving and conforming to a side rail 56 of a ladder. The elongated frame 16 extends over a length of the side rail 56 equal to a distance between at least two ladder rungs 52 and 54 respectively. The elongated frame 16 defines a channel 44 including a narrow elongated top section 61 covering a top edge 62 of the side rail 56 of the ladder, a wide elongated outside section 63 covering an outside or external side 64 of the side rail 56 extending orthogonally from the narrow elongated section 61, and a narrow elongated inside section 65 covering an internal side 66 of the side rail 56 extending orthogonally from the narrow elongated section 61. A least two hooks 12 are formed near the top and bottom of the narrow elongated inside section 65 in alignment one above the other at selected spacing extending from the front portion of the narrow elongated inside section toward the rear. Each hook 12 defines a top horizontal member 22,24, with a distal end member defining a finger 34,36 extending downward vertically therefrom. Each one of the hooks 12 rests upon a top surface 67 of a selected rung 52,54 with the distal end member or finger 34,36 partially encircling the selected rung 52,54 thereby providing means for supporting and removably holding the elongated frame 16 to the ladder side rail 56 and rungs 52, 54. Each of the hooks 12 formed from the narrow elongated inside section 65 of the channel 44 being spaced apart from the wide elongated section 63 of the channel 44 a selected distance slightly wider than the side rail 56 of the ladder to provide a snug fit therewith. The hooks 12 project away from the narrow elongated inside section 65 spaced apart from one another a selected distance conforming to the distance between adjacent rungs 52 and 54 of the ladder.

The ladder tray may include means for adjusting the width of the channel 44 such as a shim 94 inserted into the channel 44 at a selected position.

A foldable shelf 40 extends from the elongated bracket 16. A hinge means 68 for foldably holding and pivoting the shelf 40 is mounted to or formed integrally with the elongated frame 16. The foldable shelf 40 can include means for retaining an object on a top surface of the shelf selected from the group consisting of an aperture, a groove, a depression, a ridge, and a textured surface. The shelf 40 includes a pair of spaced apart shelf lugs 13 and 14 extending from an edge 69 adjacent the elongated frame 16. The elongated frame 16 includes at least one frame lug 41 extending therefrom at an angle horizontal to the ground correspondingly engaging the pair of spaced apart lugs 14 and 16 of the shelf 40 aligned therewith. A connecting means such as a rod, pin 42, or posts and indention or slot provides pivoting support for connecting the shelf lugs 14 and 16 to the at least one the frame lug 41.

Figure 14:
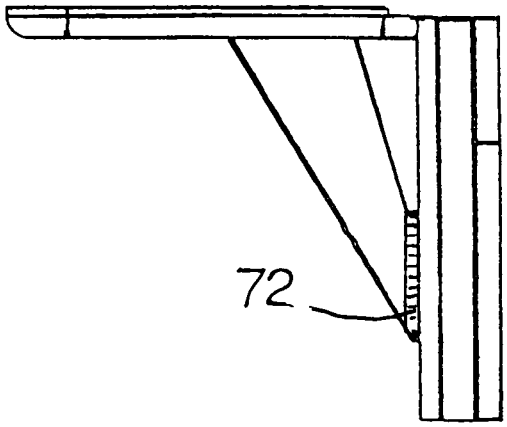
FIG. 14 is a rear view of a ladder tray.
Figure 15:
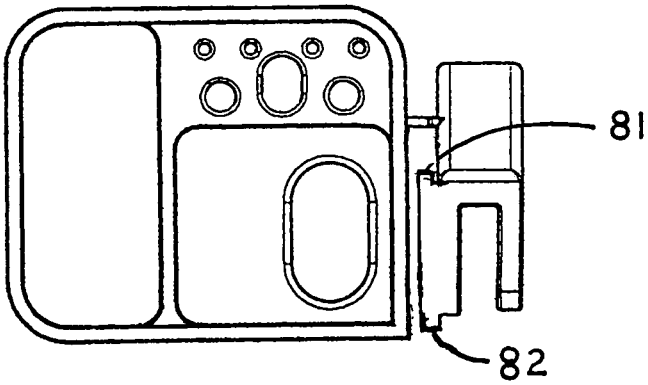
FIG. 15 is a top view of a ladder tray showing the posts extending from the elongated frame lug for attachment to the shelf lugs (not shown)

As illustrated in the drawings, a generally longitudinal shelf support member 18 is supported by and extends outwardly from a wide elongated outside section the shelf support member 18 including a top end edge 70 for cooperatively engaging and supporting a bottom surface 71 of the foldable shelf 40. The shelf support 18 includes means for pivoting from the storage position outwardly away from the elongated frame 16 nearly perpendicular thereto providing maximum structural support and stability to the shelf 40 resting thereon. The means for pivoting can be a hinge connecting the shelf support 18 to the elongated outside section of the elongated frame 16 whereby the hinge is oriented approximately in the vertical axis. It is contemplated that the hinge may comprise a piano hinge 72 as shown in FIG. 14. The means for pivoting the structural member may also comprise a bore or groove extending along the outer edge 74 of the support member 18 adjacent to the elongated frame 16 including a pair of spaced apart aligned support lugs 30 pivotally connected by a rod or pin 73. Thus, the hinge may comprise a pair of spaced apart aligned shelf support lugs 30 extending from the elongated outside section 63 pivotally engaging a distal end 74 of the shelf support 18 extending there between. The lower side edge 74 of the shelf support 18 and at least a portion of the shelf 40 pivotally engage support lugs 30 including a bore there through and a pin 32 extending through the bore of the shelf support and the at least a portion of the lugs 30 pivotally connecting same. It is contemplated that the shelf support 18 can be formed having pegs extending from the top and bottom of the distal end 74 which cooperatively engage detents formed in the lugs 30 of the elongated frame 16 providing pivotal movement thereof.

Figure 18:
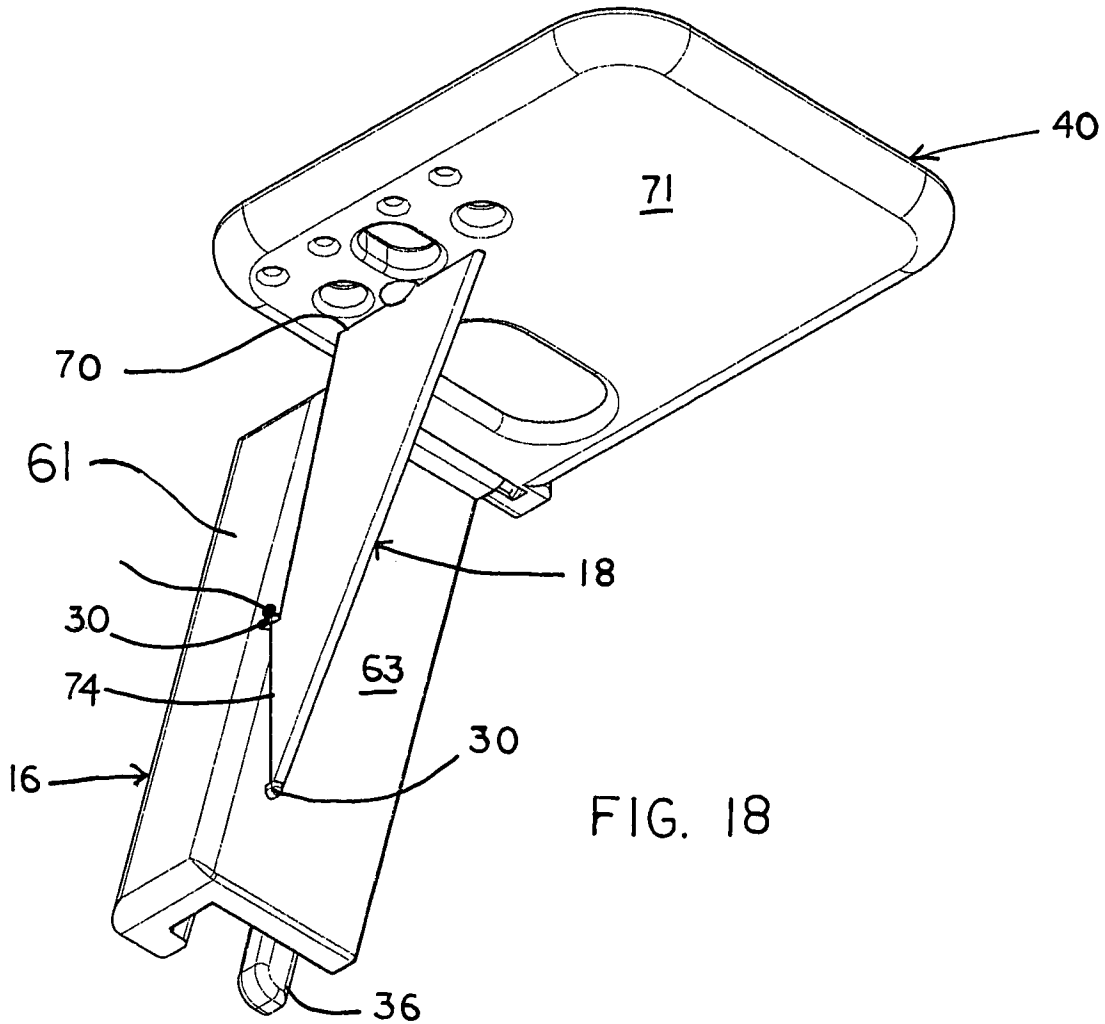
FIG. 18 is a isometric bottom view of the ladder tray.
Figure 19:
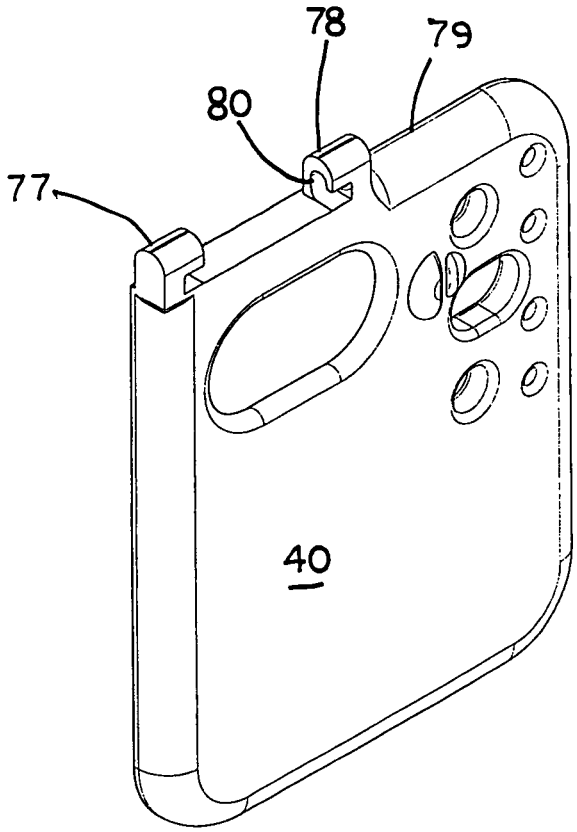
FIG. 19 is an isometric bottom view of the folding shelf.
Figure 20:
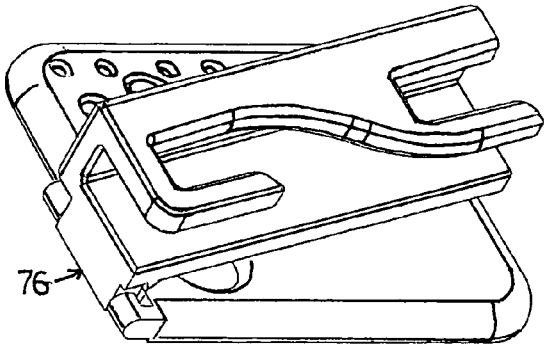
FIG. 20 is a bottom perspective view of the ladder tray in the folded position.

As best shown in FIGS. 18, 19 and 20, in at least one preferred embodiment, the foldable shelf 40 includes pivoting holding means comprising a hinge 76 including at least one pair of spaced apart lugs 77, 78 extending from the edge 79 of the shelf 40 adjacent the elongated frame 16, wherein each lug 77, 78 includes a "C-shaped" notch 80 formed in the bottom interior portion of the lugs opposing one another for cooperative pivoting engagement with a pair of opposing posts 81, 82 extending from a center lug or flange 83 extending outwardly from the top edge of the wide elongated outside section 63 of the elongated frame 16.

Figure 21:
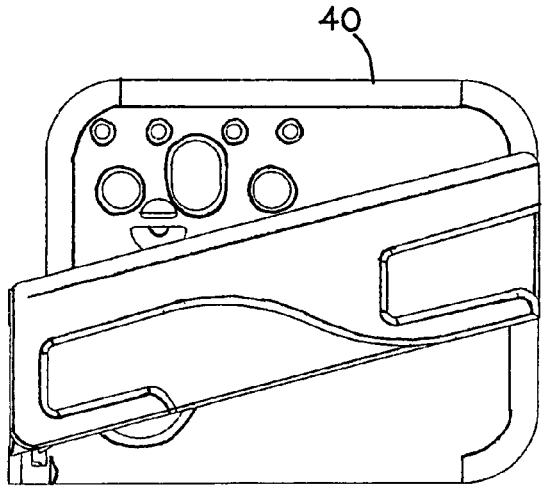
FIG. 21 is a bottom view of the ladder tray in the folded storage position.
Figure 22:
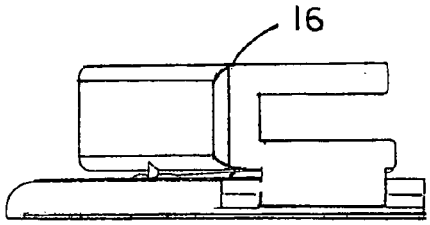
FIG. 22 is a top view of the ladder tray in the folded position.
Figure 23:
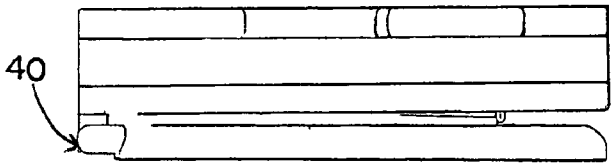
FIG. 23 is a bottom view of the ladder tray in the folded position.

Moreover, it as shown in FIGS. 18 and 21, the foldable shelf 40 may include a bottom surface 71 having a pair of spaced apart projections or lugs 90, 91 forming a notch 92 thereinbetween sized for cooperatively and detachably engaging the top end edge 70 the shelf support 18.

Figure 16:
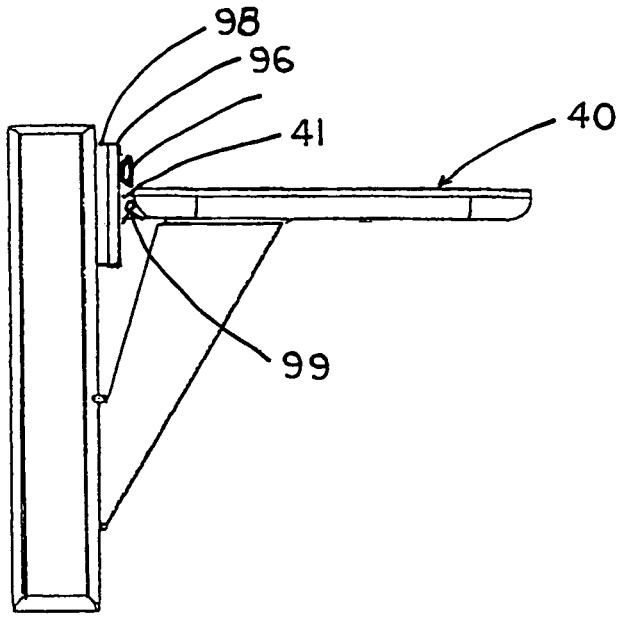
FIG. 16 is a front view of the ladder tray shown utilizing the pivot adjustment mechanism of FIG. 13.
Figure 17:
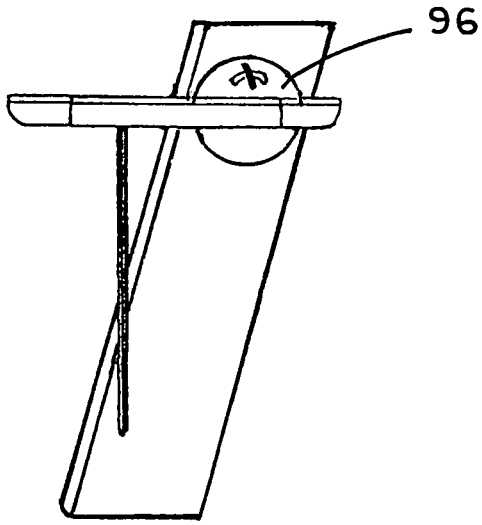
FIG. 17 is a right side view of the ladder tray and the pivot adjustment mechanism of FIG. 13.

The ladder tray of claim 1, may also include a means for pivoting the folding shelf 40 with respect to the elongated frame 16. As shown in FIGS. 16 and 17, the means for pivoting comprises means for hinging comprising a pair of interconnecting and adjustable disc 95, 96 disposed between the foldable shelf 40 and frame for foldably holding and pivoting the shelf 40 with respect to the elongated frame 16.

It is possible to provide means for pivoting with a single first disc 96 wherein disc 96 is rotatably supported by an axle, peg or other member extending from a pivoting hinge 99 affixed to the shelf 40. Means for biasing the disc 96 against the exterior surface of the wide elongated section 63 of the elongated frame 16 may comprise a threaded member which threadably engages a threaded bore formed at a selected location within the disc 96.

Preferably a second disc 98 or other friction enhancing holding surface attaches to the wide elongated section 63 for cooperative rotational engagement with the first disc 96. It is contemplated that either the interior surface of the first disc 96, the external surface of the second disc 98, or the mating surfaces of both disc 96 and 98 may include a friction enhancing means such as abrasive surface, teeth, knurled surface, sand paper or the like.

Figure 12:
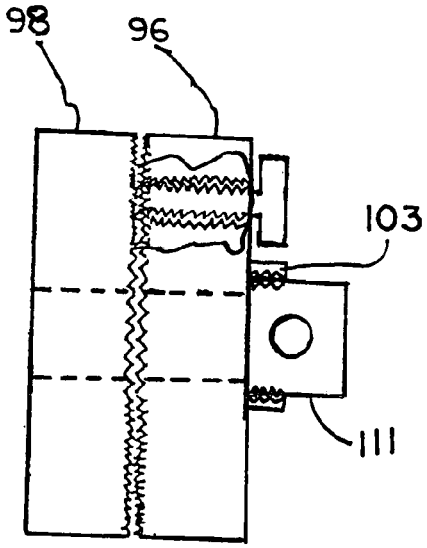
FIG. 12 is a side view of a locking mechanism for pivoting the shelf at a selected angle with respect to the elongated frame and ladder.
Figure 13:
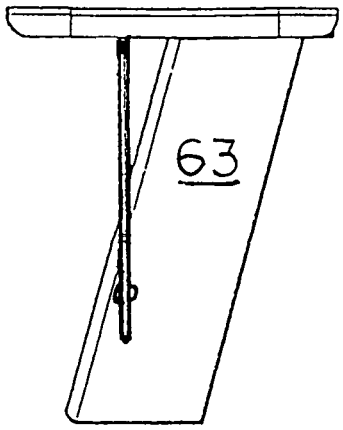
FIG. 13 is a right side view of a ladder tray showing the shelf supported by a shelf support member pivotally supported on the elongated frame.

As shown in FIG. 12, FIG. 16 and FIG. 17, a threaded bore 100 is formed through the first disc 96 in threaded engagement with the threads of a threaded bolt 101 disposed through the first disc 96 to biases the shelf 40 against the elongated frame 16 at a selected angle. Providing an axle 111 with a threaded distal end 102 can also be utilized to tighten the first disc 96 to the second disc 98 or alternatively the frame 16 with a wing nut 103 or the like.

FIGS. 20-23 show the ladder tray 10 of the present invention in various views after folding same to a substantially flat configuration.

The foregoing detailed description is given primarily for clearness of understanding and no unnecessary limitations are to be understood therefrom, for modification will become obvious to those skilled in the art upon reading this disclosure and may be made upon departing from the spirit of the invention and scope of the appended claims. Accordingly, this invention is not intended to be limited by the specific exemplification presented herein above. Rather, what is intended to be covered is within the spirit and scope of the appended claims.

I claim:

1. A pivotally adjustable ladder tray in combination with a ladder having at least two rungs, a first side rail and a second side rail, the ladder tray consisting of:

an elongated frame including an elongated top section covering a top edge of said first side rail, an elongated outside section covering an external side of said first side rail and extending orthogonally from said elongated top section, and an elongated inside section covering an internal side of said first side rail and extending orthogonally from said elongated top section;

said elongated frame extending over a major length of said first side rail at least a distance between an adjacent pair of rungs of said at least two rungs;

two hooks protruding from said elongated inside section and separated a distance equal to the distance of the adjacent pair of rungs, each hook respectively defining a top horizontal member with a distal end member extending downwardly and vertically therefrom;

each one of said hooks resting upon a top surface of the selected adjacent rungs of said ladder respectively with the distal end members respectively partially encircling said adjacent rungs to removably hold said elongated frame to said first rail and said adjacent rungs;

said hooks and said elongated inside section are coplanar and lie within a first plane, the first plane aligns parallel to a second plane formed by the elongated outside section and between the two planes defines a channel with a width, wherein the width of the channel is wider than a width of the first side rail so that the channel of the elongated frame can receive the first side rail;

a foldable shelf extending from said elongated frame via a first hinge that directly connects the foldable shelf and the elongated outside section, the first hinge allows the foldable shelf to pivot between a first shelf position and a second shelf position, said shelf including a rim extending around all four sides of a peripheral edge of said shelf, said shelf including a pair of spaced apart shelf lugs of the first hinge that extend from an edge of the shelf adjacent to said elongated frame, said elongated frame including a frame lug of the first hinge that correspondingly engages said pair of spaced apart shelf lugs via a means for pivotably connecting said shelf lugs to said frame lug;

an elongated pivotable shelf support having a bottom end directly attached to a second hinge, the second hinge being directly attached to the elongated outside section and capable of pivoting the pivotable shelf support between a first support position and second support position, said shelf support including a top end edge that cooperatively engages and supports a bottom surface of said foldable shelf in the first support position and in the first shelf position, when the shelf support is positioned in the second support position it is substantially orthogonal to the first support position and is aligned substantially flat against the elongated outside surface while further allowing the foldable shelf to fold to the second shelf position which is substantially orthogonal to the first shelf position and substantially aligned flat against the shelf support;

the elongated pivotable shelf support extends outwardly from the elongated outside section at an angle of 15 degrees with respect to a major length of the elongated outside section.

2. The ladder tray of claim 1, said foldable shelf including holding means selected from the group consisting of an aperture, a groove, a depression, a ridge, and a textured surface.

3. The ladder tray defined in claim 1 wherein said ladder tray is made from a material selected from the group consisting of structural foam material, aluminum, fiberglass, plastic and combinations thereof.

* * * * *